United States Patent [19]

McGowan

[11] 4,399,169

[45] Aug. 16, 1983

[54] INSULATIVE END CAP FOR CYLINDRICAL METAL DRYING ROLLERS OF PAPER DRYING MACHINES, AND PROCESS FOR FABRICATION THEREOF

[76] Inventor: Paul J. McGowan, P.O. Box 576, Ludowici, Ga. 31316

[21] Appl. No.: 276,078

[22] Filed: Jun. 22, 1981

[51] Int. Cl.[3] ..... B32B 3/02; F26B 25/20

[52] U.S. Cl. ..... 427/284; 29/123; 29/132; 34/110; 138/109; 156/69; 156/305; 156/330; 252/62; 427/287; 427/386

[58] Field of Search ..... 29/110, 123, 132; 138/96 R, 109; 174/89; 156/69, 305, 330; 34/110; 427/386, 284, 287; 432/236, 246; 252/62

[56] References Cited

U.S. PATENT DOCUMENTS

| | | | |
|---|---|---|---|
| 1,076,330 | 10/1913 | Thompson | 29/132 |
| 1,640,855 | 8/1927 | Shlick | 34/110 |
| 2,571,426 | 1/1950 | Doniak | 29/132 |
| 2,591,307 | 3/1950 | Sibel | 29/132 |
| 3,820,947 | 6/1974 | Bota et al. | 432/234 |
| 3,941,635 | 3/1976 | Tavelle et al. | 156/86 |
| 4,035,212 | 7/1977 | McRitchie | 156/187 |
| 4,192,080 | 3/1980 | Irpola | 34/41 |
| 4,241,518 | 12/1980 | Alexy | 34/110 |
| 4,321,759 | 3/1982 | Gamble | 34/110 |

*Primary Examiner*—P. E. Willis, Jr.
*Attorney, Agent, or Firm*—Phillips & Mozley

[57] ABSTRACT

An improved insulative end cap for cylindrical metal drying rollers of paper manufacturing machines, a method of providing insulative end caps for cylindrical metal drying rollers of paper manufacturing machines, and a composition of an adhesive insulative material for use in providing insulative end caps for metal drying rollers of paper drying machines.

20 Claims, 4 Drawing Figures

INSULATIVE END CAP FOR CYLINDRICAL METAL DRYING ROLLERS OF PAPER DRYING MACHINES, AND PROCESS FOR FABRICATION THEREOF

BACKGROUND OF THE INVENTION

The present invention is an improved insulative end cap for cylindrical metal drying rollers of paper drying machines; a composition of matter for use in providing such insulative end caps of cylindrical metal drying rollers of paper drying machines; and a method of manufacture of insulative end caps for cylindrical metal drying rollers of paper drying machines.

Conventional paper drying machines include a plurality of cylindrical metal drying rollers over which continuous sheets of paper are passed to dry the paper as one of the final steps in the manufacture of paper. The cylindrical metal drying rollers are generally hollow and such cylindrical metal drying rollers are heated by the introduction of high-temperature and high-pressure steam into the hollow interior of the cylindrical metal drying rollers. The introduction of such high-temperature and high-pressure steam is provided in order to heat the drying surfaces of the cylindrical metal drying rollers.

A problem commonly encountered in such cylindrical drying rollers is the loss of a substantial amount of energy through the metallic end caps of the cylindrical metal drying rollers. The metal used to manufacture such conventional end caps does not generally have good insulative properties, and the temperature of the high-pressure and high-temperature steam within the cylindrical metal drying roller is often as high as 320° Fahreinheit, and the outside air temperature adjacent the paper drying machine is generally at room temperature. Such substantial difference between the temperature on the inside of the metal end cap and the temperature on the outside of the metal end cap of the cylindrical metal drying roller, combined with the poor insulative qualities of the metal presently conventionally used as the end caps for such cylindrical metal drying rollers, results in high rate of heat loss through the end caps and a substantial waste of energy.

A large paper drying machine may include up to one hundred such cylindrical drying rollers. Additionally, such paper drying machines often operate continuously during the paper manufacturing process. Accordingly, the heat lost from such a substantial number of cylindrical metal drying rollers operated continuously in the paper manufacturing process results in substantial and significant additional manufacturing costs due to the additional energy required to replace energy wasted by heat loss through the metal end caps of the cylindrical metal drying rollers of the machine.

SUMMARY OF THE INVENTION

The object of the present invention is to provide an improved insulative end cap for cylindrical metal drying rollers.

A further object of the present invention is to provide a process for providing insulative end caps for cylindrical metal drying rollers.

A still further object of the present invention is to provide a method of providing an insulative end cap for cylindrical metal drying rollers which permits such insulative end caps to be installed while the metal drying machine is in operation and without the need for stopping the paper manufacturing process to install such insulative end caps.

An additional object of the present invention is to provide a composition for an adhesive insulative material for use in providing insulative end caps for cylindrical metal drying rollers.

The foregoing objects and still further objects will be understood based upon the following Description of Preferred Embodiments and Drawings in which the numbered parts described in the Description of Preferred Embodiments are all shown by like numbered parts in the drawings.

DETAILED DESCRIPTION OF PREFERRED EMBODIMENTS

The following description sets forth preferred embodiments of the present invention. The following Description of Preferred Embodiments is not intended to be an exhaustive description of all of the alternative embodiments of the present invention, but is intended to disclose preferred embodiments of the invention. Accordingly, it will be understood that the scope of the present invention and the alternative embodiments encompassed thereby is limited only by the appended claims and not by the preferred embodiments set forth herein.

Figure 1:
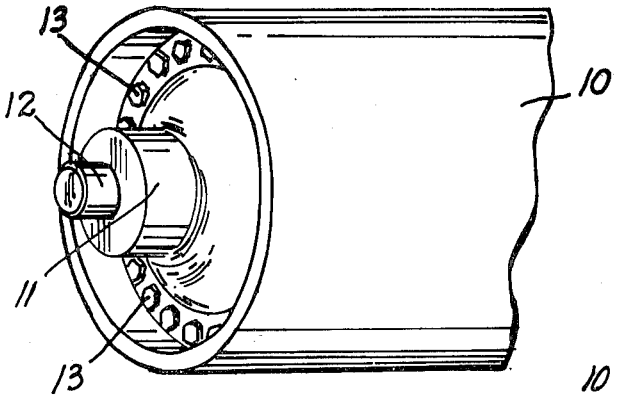
FIG. 1 is a perspective view showing the metal end cap of a cylindrical metal drying roller before an insulative end cap has been provided.

As shown in FIG. 1, the metal end cap 11 of a conventional cylindrical metal drying roller 10 is circumferentially arranged about the axis 12 around which the cylindrical metal drying roller 10 rotates during the paper drying operation. The metal end cap 11 covers the entire area between said axis of rotation 12 and the inner surface of the hollow cylindrical metal drying roller 10 thereby providing a complete end cap for the cylindrical metal drying roller. Said end cap 11 is conventionally fastened to the cylindrical metal drying roller 10 by mechanical means such as the bolts 13.

The end cap 11 of the cylindrical metal drying roller is conventionally made of metallic material which does not provide a good insulator. Accordingly, the drying heat provided by the high-temperature and high-pressure steam which is introduced into the interior of the hollow cylindrical metal drying roller 10 may be lost due to conduction through the metal end cap 11 and through convection to the outside room air which is at a temperature substantially lower than the temperature within the cylindrical metal drying roller 10.

Figure 4:
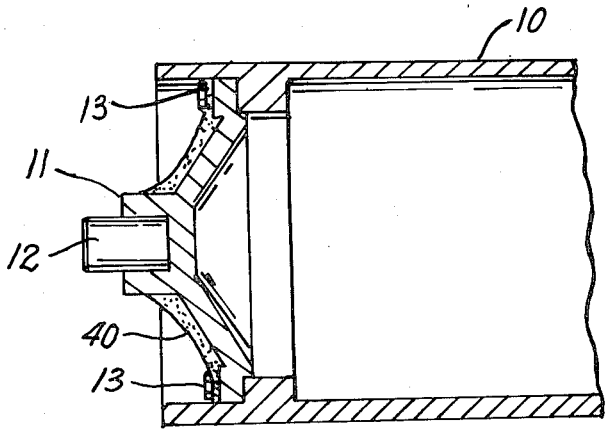
FIG. 4 is a sectional view of the end cap of a cylindrical metal drying roller illustrating a preferred embodiment of an improved insulative end cap of a cylindrical metal drying roller according to the present invention.

Referring now to FIG. 4, the present invention includes a process for providing an insulative end cap 40 in order to provide an insulator for the outer surface of the metal end cap 11 of the cylindrical metal drying roller 10. As will be set forth more fully below, the composition of the material used for the insulative end cap 40 and the thickness of the insulative layer of the insulative end cap 40 may be varied in order to achieve the desired level of insulation and in order to minimize the heat lost through said metal end cap 11 and said insulative end cap 40.

The method of providing an insulative end cap 40 according to the present invention includes the use of an adhesive insulative material which is capable of being applied to the outer surface of the metal end cap 11 and which is capable of adhering to the outer surface of said metal end cap 11 and capable of hardening to provide a solid layer of insulative end cap 40 of the desired thickness over the outer surface of the metal end cap 11.

Additionally, in the preferred embodiments set forth herein, said adhesive insulative material is a composition which includes an adhesive material, an insulative material selected for its suitable insulative qualities, and a filler material to provide strength to the composition to prevent the insulative end cap 40 from cracking or from deteriorating after it has hardened and during the operation of the cylindrical metal paper drying rollers in their customary operating environment.

Of course, the components and the composition of the adhesive insulative material may differ from one application to another. Generally, the objectives in selecting the components for the composition for the adhesive insulative material are to select a suitable insulative material which is both a good insulator and which is also capable of being introduced in a substantial amount into a mixture with a suitable adhesive and a suitable filler. In this regard, the selection of the insulative material will depend both upon its inherent insulative qualities and also upon the volume of such insulative material which can be introduced into the mixture. Finally, the volume of insulative material which may be introduced into the mixture will also depend upon the thickness or consistency of the mixture desired in order to provide a suitable mixture for application of the composition to the outer surface of end cap 11.

It has been found that powdered calcium silicate provides a suitable insulative material capable of being introduced in a mixture with adhesive and filler material in a volume sufficient to provide the desired insulative qualities. In introducing such powdered calcium silicate to such a mixture, the powdered calcium silicate should be added to the mixture in the maximum amount possible without making the mixture too thick for the desired method of application of the composition of adhesive insulative material to the metal end cap 11.

It has also been found that a suitable adhesive is epoxy used with the standard and appropriate epoxy activator. The volume of epoxy used must be sufficient to cause the composition of adhesive insulative material to adhere to the outer surface of the metal end cap 11 and to harden to provide a solid insulative end cap 40 of the desired thickness over the outer surface of the metal end cap 11.

The adhesive may also include a suitable thinner for such adhesive, and in the case of epoxy a suitable thinner has been found to be a composition of methyl ethyl ketone and xylol. The amount of thinner may also be varied to determine and to achieve the desired thickness for the composition of the adhesive insulative material.

Of course, other adhesives, such as urethane, may also be suitable for use in providing a suitable composition for an adhesive insulative material.

It has been found that chopped fiberglass provides a suitable filler component for an adhesive insulative material, and that such chopped fiberglass provides suitable strength to prevent cracking of the insulative end cap 40 after the adhesive insulative material has hardened. Additionally, such chopped fiberglass has also been found to assist in binding the grains of the powdered calcium silicate insulative material.

It has been found that a composition for an adhesive insulative material including a mixture of the following components in the following proportions provides a preferred adhesive insulative material:

(a) Powdered calcium silicate—15% by weight;
(b) Chopped fiberglass—2.5% by weight;
(c) Epoxy (including activator)—60% by weight; and
(d) Epoxy thinner—22.5% by weight.

In the composition set forth above, a thinner including 75% methyl ethyl ketone and 25% xylol has been found to provide a suitable thinner.

The foregoing components, excluding the activator for the epoxy, may be mixed in a tub or vat by use of an electric or manual mixer. The composition (without the activator) should then be sealed until ready for use, and the composition should only be opened and an activator added just prior to application of the adhesive insulative material to the outer surface of the metal end caps in accordance with the methods to be described more fully below. Of course, once the activator has been added to the composition, the composition should be applied to the outer surface of the metal end cap 11 within a reasonably short time depending upon the composition used in order to avoid hardening of the adhesive insulative material prior to installation. It has been found that the preferred adhesive insulative material described above may be applied as long as two hours or more after the activator has been added.

The adhesive insulative material of the present invention permits the application of an insulative end cap 40 either by spraying such adhesive insulative material from a pressure placement pump on to the outer surface of the metal end cap 11 or by applying such adhesive insulative material to the metal end cap 11 by hand using a trowel 20. The advantage of applying the adhesive insulative material by use of a pressure placement pump is that such material may be applied quickly. In the event a pressure placement pump is chosen, any pressure placement pump of conventional design having a pressure differential of one to ten to one to forty has been found suitable. Such pressure placement pumps are commonly used for masking and for texture in applying sheet rock. Additionally, a spray nozzle having a masking head should also be used for spray application. A fuel tip of ¼" to 1" has also been found suitable for pressure placement pump application. Finally, the pressure in the pump should be as low as practical but may vary over a broad range, such as from 5 psi to 80 psi.

Figure 3:
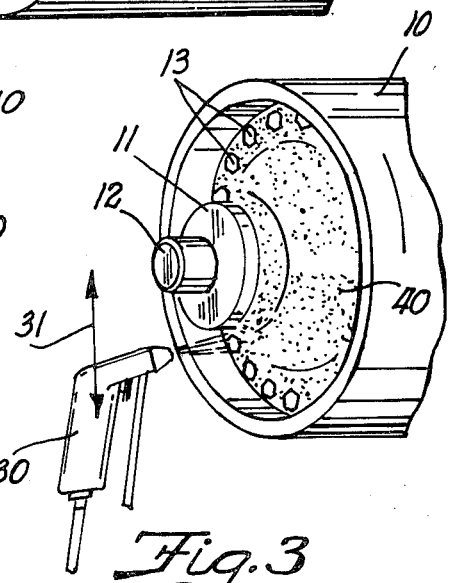
FIG. 3 is a perspective view of said end cap of a cylindrical metal drying roller showing a second alternative method of installation of an insulative end cap according to the present invention.

Additionally, the application of the adhesive insulative material by spraying using a pressure placement pump may be performed while the cylindrical drying roller 10 is in operation. Such installation may be achieved by spraying the adhesive insulative material along a radial line, such as the line 31 illustrated in FIG. 3, extending from the axle 12 of the cylindrical metal drying roller 10 to the inner circumference of the cylindrical drying roller 10. By moving the spraying nozzle back and forth along such line 31 while the cylindrical metal drying roller 10 is rotating, a uniform insulative end cap 40 may be applied to the metal end cap 11 without interrupting the operation of the cylindrical metal drying roller 10.

Figure 2:
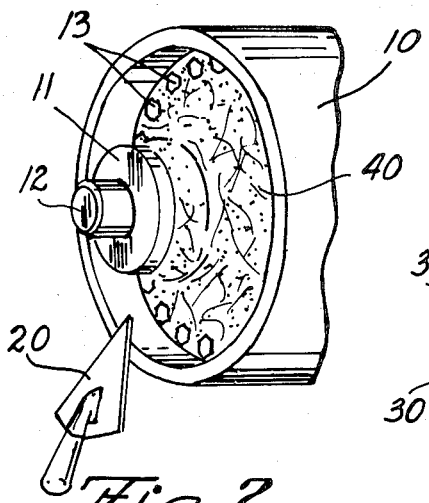
FIG. 2 is a perspective view of said end cap of a cylindrical metal drying roller showing a first alternative method of installation of an insulative end cap for said cylindrical metal drying roller according to the present invention.

Alternatively, as shown in FIG. 2, the insulative and end cap 40 may be applied to the metal end cap 11 by using a trowel 20. Such application should be performed while the cylindrical metal drying roller 10 is stationary. Additionally, such method of application of the adhesive insulative material cannot be performed as quickly as application of the adhesive insulative material by use of a pressure placement pump 30.

The advantage of applying the adhesive insulative material by a trowel 20 is that a thicker consistency of adhesive insulative material may be applied. The capability of applying adhesive insulative material of a thicker consistency permits more of the insulative material, such as calcium silicate, to be introduced into the composition of the adhesive insulative material. In this manner, the insulative properties of the adhesive insulative material may be improved and the desired insulative effects may be achieved by applying less adhesive insulative material to each cylindrical metal drying roller 10.

An additional advantage of applying the adhesive insulative material by hand is that the outer surface of the insulative end cap 40 may be smoothed by the use of the trowel 20 while the cylindrical metal drying roller 40 is stationary. Of course, the outer surface of an insulative end cap 40 applied by use of a pressure placement pump may also be smoothed by use of a trowel, but the use of the trowel requires that the cylindrical metal drying roller 10 be stationary.

The adhesive insulative material which provides the insulative end cap 40 must be permitted to harden after application. It has been found that the insulative end cap 40 using the perferred composition set forth above can be permitted to harden while the paper drying machine is in operation.

It has been found that, using the preferred composition of adhesive insulative material set forth above, an insulative end cap 40 of ¾" to 1" in thickness provides the desired maximum insulation in many installations. In this regard, it has been found that such insulative end cap 40 results in a drop in temperature of the outer surface of the end of the cylindrical metal drying roller from 320° Fahreinheit to room temperature following the application of the insulative end cap 40. Of course, the thickness required to achieve the desired insulative effects may vary depending on the characteristics of the drying rollers to be insulated.

It will be understood by those skilled in the art that the foregoing description of Preferred Embodiments has not been exhaustive of the various alternative embodiments of the present invention, and has been merely illustrative and exemplary of the preferred embodiments of the present invention. It will also be understood that additional embodiments fall within the spirit and scope of the present invention, and that the present invention is limited solely by reference to the appended claims.

I claim:

1. A process for providing surface insulation for the outer surfaces of end caps of cylindrical metal drying rollers of paper manufacturing machines, including the following steps:

(a) Applying adhesive insulative material to the outer surface of said end cap, said adhesive insulative material being capable of adhering to the outer surface of said end caps and further being capable of hardening to provide a solid layer of insulation of desired depth over said outer surface of said end cap; and (b) Permitting said adhesive insulative material to harden to provide a solid layer of insulation of desired depth over the outer surface of said end caps.

2. A process for providing surface insulation as claimed in claim 1, wherein said adhesive insulative material includes a mixture including the following components:

(i) An insulative material (ii) A filler material; and (iii) An adhesive capable of being applied to said outer surface of said end cap and capable of adhering to said outer surface of said end cap and capable of hardening to provide a solid layer of insulation of the desired depth over said outer surface of said end cap.

3. A process for providing surface insulation as claimed in claim 2, wherein said insulative material includes a powdered insulative material.

4. A process for providing surface insulation as claimed in claim 2, wherein said filler material includes fiberous filler material.

5. A process for providing surface insulation as claimed in claim 2, wherein said adhesive includes epoxy.

6. A process for providing surface insulation as claimed in claim 2, wherein said adhesive includes urethane.

7. A process for providing surface insulation as claimed in claim 3, wherein said powdered insulative material includes powdered calcium silicate.

8. A process for providing surface insulation as claimed in claim 3, wherein said fiberous filler material includes chopped fiberglass.

9. A process for providing surface insulation as claimed in claim 7, wherein said filler material included chopped fiberglass.

10. A process for providing surface insulation as claimed in claim 8, wherein said insulative material includes powdered calcium silicate and wherein said fiberous filler material includes chopped fiberglass in the range of at least 2.5% by weight.

11. An improved insulative end cap for the outer surface of end caps of cylindrical metal drying rollers of paper drying machines, wherein said improved insulator is produced by a method including the following steps:

(a) Applying adhesive insulative material to the outer surface of said end cap, said adhesive insulative material being capable of adhering to the outer surface of said end caps and further being capable of hardening to provide a solid layer of insulation of desired depth over said outer surface of said end caps; and (b) Permitting said adhesive insulative material to harden to provide a solid layer of insulation of desired depth over the outer surface of said end caps.

12. An improved insulator as claimed in claim 11, wherein said adhesive insulative material includes a mixture including the following components:

(i) An insulative material;
(ii) A filler material; and
(iii) An adhesive capable of being applied to said outer surface of said end cap and capable of adhering to said outer surface of said end cap and capable of hardening to provide a solid layer of insulation of the desired depth over the outer surface of said end cap.

13. An improved insulative end cap as claimed in claim 12, wherein said insulative material includes powdered insulative material.

14. An improved insulative end cap as claimed in claim 12, wherein said filler material includes a fiberous filler material.

15. An improved insulator as claimed in claim 12, wherein said adhesive includes epoxy.

16. An improved insulator as claimed in claim 12, wherein said adhesive includes urethane.

17. An improved insulator as claimed in claim 13, wherein said powdered insulative material includes powdered calcium silicate.

18. An improved insulator as claimed in claim 14, wherein said fiberous filler material includes chopped fiberglass.

19. An improved insulator as claimed in claim 17, wherein said filler material includes chopped fiberglass.

20. An improved insulator as claimed in claim 18, wherein said insulative material includes powdered calcium silicate and wherein said fiberous filler material includes chopped fiberglass in the range of at least 2.5% by weight.

* * * * *